US011377322B2

(12) United States Patent
Li

(10) Patent No.: US 11,377,322 B2
(45) Date of Patent: Jul. 5, 2022

(54) ROTARY SELF-LOCK CATCH

(71) Applicant: Huiqing Li, Shenzhen (CN)

(72) Inventor: Huiqing Li, Shenzhen (CN)

( * ) Notice: Subject to any disclaimer, the term of this patent is extended or adjusted under 35 U.S.C. 154(b) by 0 days.

(21) Appl. No.: 17/566,716

(22) Filed: Dec. 31, 2021

(65) Prior Publication Data

US 2022/0119220 A1 Apr. 21, 2022

(30) Foreign Application Priority Data

Dec. 22, 2021 (CN) ..... 202123247658.7

(51) Int. Cl.
*B65H 75/48* (2006.01)
*B65H 75/40* (2006.01)
*B65H 75/44* (2006.01)

(52) U.S. Cl.
CPC ..... *B65H 75/406* (2013.01); *B65H 75/4431* (2013.01)

(58) Field of Classification Search
CPC .. B65H 75/48; B65H 75/406; B65H 75/4431; B65H 75/4473
See application file for complete search history.

(56) References Cited

U.S. PATENT DOCUMENTS 8,235,321 B2 * 8/2012 Chen ..... A43C 11/008 242/378.1
8,308,098 B2 * 11/2012 Chen ..... A43C 11/008 242/378.1
2004/0172993 A1 9/2004 Furlong
2005/0098673 A1 * 5/2005 Huang ..... A43C 7/00 242/396.5
2007/0084956 A1 * 4/2007 Chen ..... A43C 7/00 242/388.6
2015/0076272 A1 * 3/2015 Trudel ..... A43C 7/00 242/381.4
2015/0308152 A1 10/2015 Kamin
2016/0316862 A1 11/2016 Ho

* cited by examiner

*Primary Examiner* — Sang K Kim
(74) *Attorney, Agent, or Firm* — Zhihua Han; Wen IP LLC

(57) ABSTRACT

The present invention discloses a rotary self-lock catch. As a rope penetrates into the take-up cavity of the take-up reel and a tail end of the rope is limited at a boundary between a through hole and a hollowed cavity, when the rotary knob is rotated, the take-up reel can be driven to rotate together, so that the rope is wound in the take-up cavity by the take-up reel, and the rotary knob is allowed to rotate along one direction, so that an effect of tightening the rope can be realized.

5 Claims, 3 Drawing Sheets

ROTARY SELF-LOCK CATCH

BACKGROUND OF THE INVENTION

1. Technical Field

The present invention relates to the technical field of self-lock apparatuses for ropes, in particular to a rotary self-lock catch.

2. Description of Related Art

As everyone knows, in daily life, when some articles with ropes are used, it is necessary to tighten and scale the ropes to realize corresponding purposes, for example, shoelaces, waistbands, packets and so on. As far as the shoelaces are concerned, the ropes are arranged on two sides of a welt, primarily aiming at tightening the welt, and therefore, shoes are worn on feet stably. When it is used, the shoelace penetrates through two rows of shoelace holes of a shoe in a cross manner, and it is necessary to tie two ends of the shoelace into a knot such as a bowknot.

However, there are usually corresponding skills to tie knots of the shoelace, the waistband or the packet. As far as some groups are concerned, for example, children, it is often the most difficult thing to tie the knots; and for another example, disabled persons or people without both hands available cannot tie the shoelace, the waistband, the packet and etc.

Furthermore, when the knot is tied, if it is needed to loosen or tighten the knot, it is further necessary to unfasten the knot and tie the knot again, so that it is relatively tedious to operate. In addition, the tied knot is always loosened in a moving process and the knot is unfastened automatically, thereby often bringing much inconvenience to users.

BRIEF SUMMARY OF THE INVENTION

In order to overcome deficiencies in the prior art, the objective of the present invention is to provide a rotary self-lock catch.

In order to achieve the purpose, the present invention adopts a technical scheme as follows:

A rotary self-lock catch, including:

a pedestal fixedly arranged on an article needed to tighten a rope, an upper end being provided with a mounting cavity and a side wall of the mounting cavity being provided with a rope penetrating opening;

an arresting disc mounted in the mounting cavity in an aligned manner, limited with the mounting cavity to be prevented from rotating, a periphery of an upper end being provided with at least one elastic buckle, a tail end thereof extending along a same rotating direction, and an outer side of the tail end of the elastic buckle being provided with a first latch inclining equal to the extending direction of the elastic buckle;

a rotary knob being buckled to the arresting disc and capable of rotating relative to the arresting disc, a middle portion of an inner cavity being provided with an abutting convex column and a side wall being provided with a second latch matched with the first latch, and a top end of the abutting convex column being provided with a third latch;

a take-up reel placed in the mounting cavity, located under the arresting disc and located on a side surface of the take-up reel to form a take-up cavity, an inner wall of the take-up cavity being provided with a through hole, the other end of the through hole being provided with a hollowed cavity, at least one spring being arranged between the bottom of the take-up reel and the mounting cavity, the take-up reel having a tendency of bouncing outwards under an action of the spring, the upper end of the take-up reel being provided with a pressing convex column and a fourth latch matched with the third latch, and under the action of the spring, a top end of the pressing convex column being placed outside the rotary knob after penetrating through center axes of the arresting disc and the rotary knob successively.

Preferably, a side surface of the arresting disc is provided with a limiting block, the limiting block is placed in the rope penetrating opening in an aligned manner, and the limiting block is provided with a wire channel communicated with the take-up cavity.

Preferably, a bottom of the mounting cavity and a bottom end of the take-up reel are respectively provided with limiting cavities at the spring, and two ends of the spring are respectively placed in the limiting cavities in an aligned manner.

Preferably, an outer side of the arresting disc is provided with at least one fastener and a position of the pedestal located at a bottom or a side wall of the mounting cavity is provided with a clamping opening matched with the fastener.

Preferably, an outer surface of the rotary knob is provided with a skidproof stripe.

By adopting the above-mentioned scheme, as a rope penetrates into the take-up cavity of the take-up reel and a tail end of the rope is limited at a boundary between a through hole and a hollowed cavity, when the rotary knob is rotated, the take-up reel can be driven to rotate together, so that the rope is wound in the take-up cavity by the take-up reel, and the rotary knob is allowed to rotate along one direction to be prevented from rotating back under the action of the elastic buckle of the arresting disc, so that an effect of tightening the rope can be realized. During use, it is no longer necessary to knot the rope. When necessary to loosen the rope, only necessary to press the pressing convex column on the take-up reel to compress the spring to separate abutment between the take-up reel and the rotary knob, and the take-up reel can rotate so as to release the rope, thereby realizing an effect of loosening the rope.

DETAILED DESCRIPTION OF THE INVENTION

Detailed description is made on the embodiments of the present invention below in combination with drawings. However, the present invention may be implemented by various different modes defined and covered by Claims.

Figure 1:
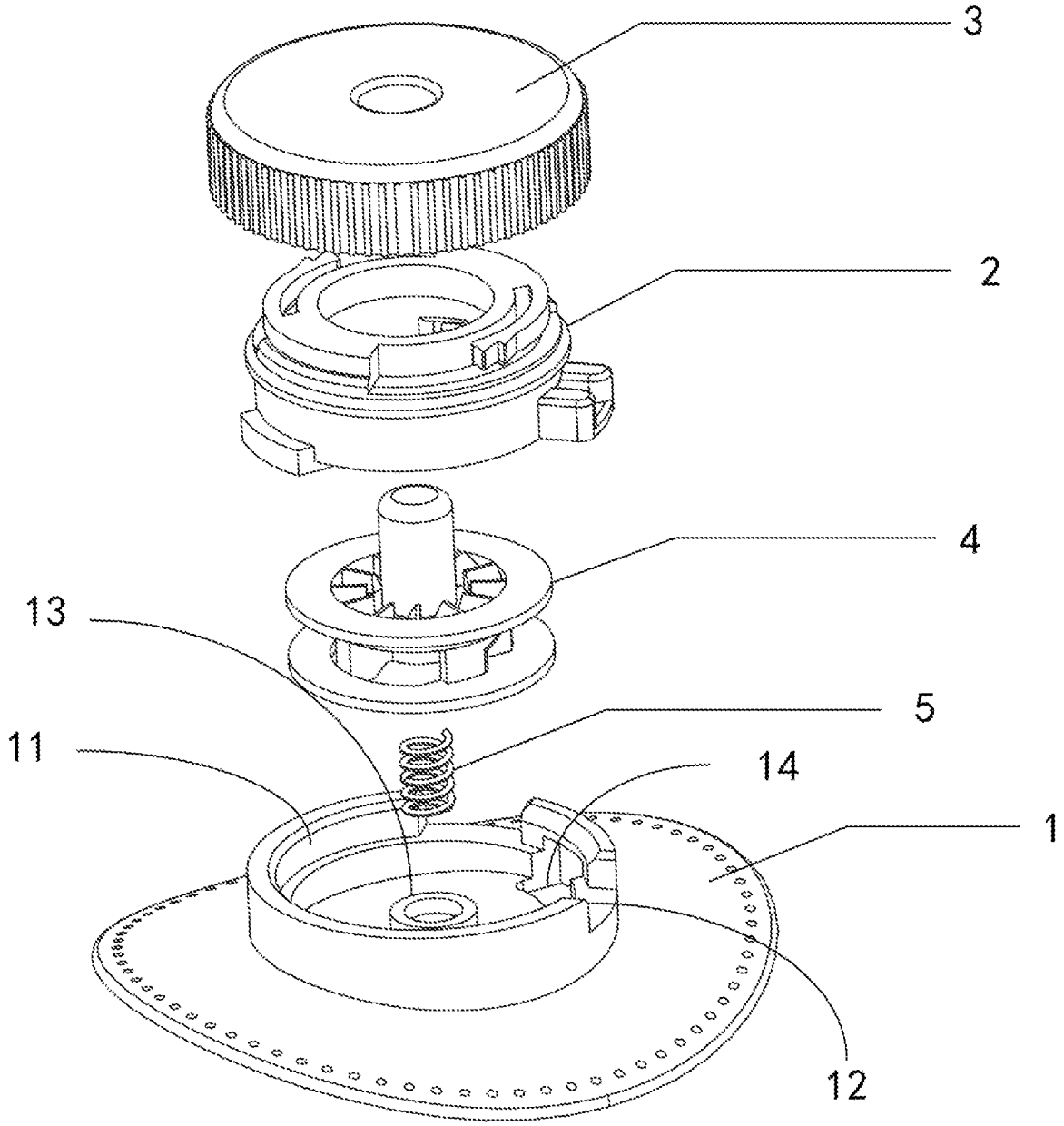
FIG. 1 is a schematic diagram of a structure principle of an embodiment of the present invention.
Figure 2:
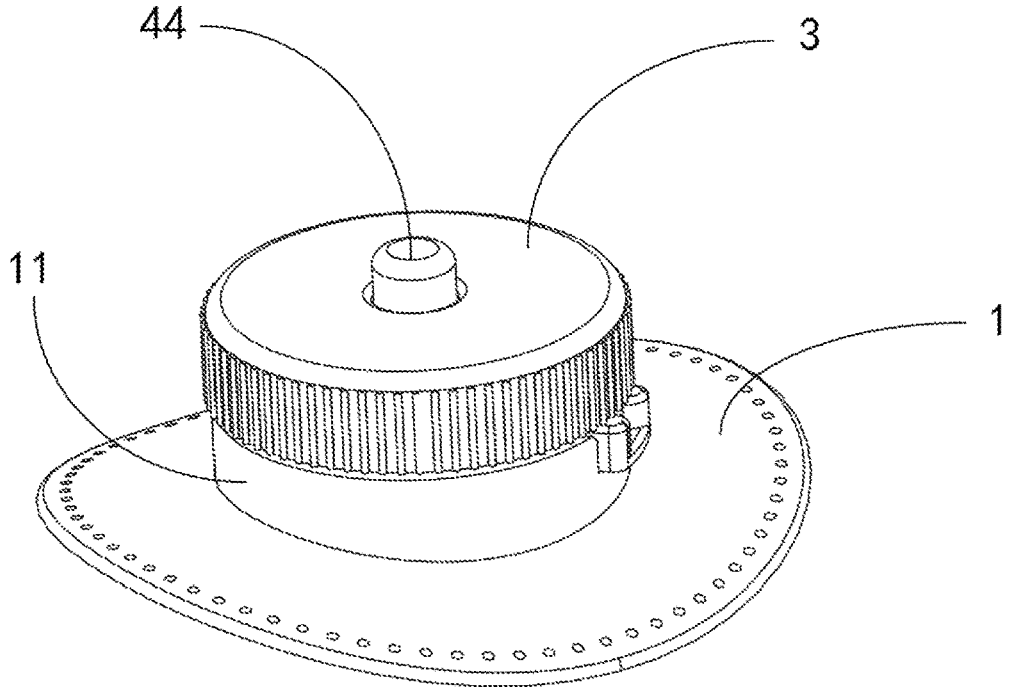
FIG. 2 is a schematic diagram of a three-dimensional structure of an embodiment of the present invention.
Figure 3:
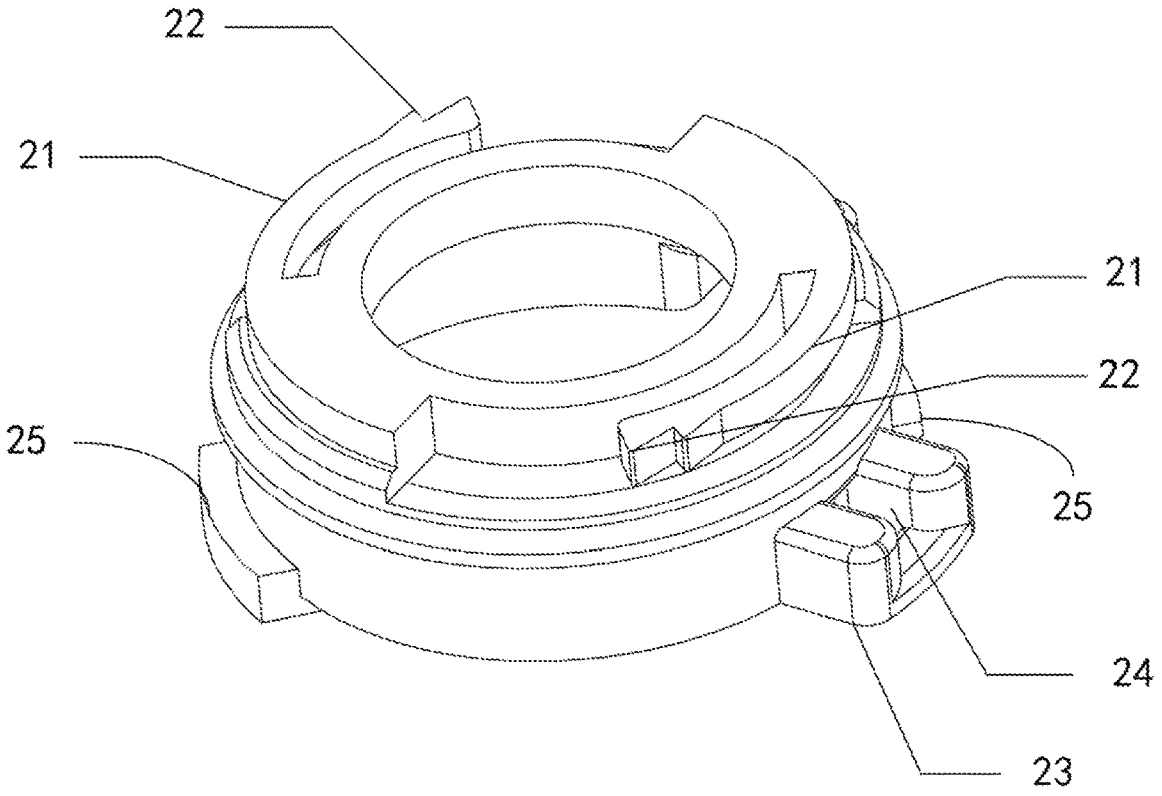
FIG. 3 is a structural schematic diagram of an arresting disc of an embodiment of the present invention.
Figure 4:
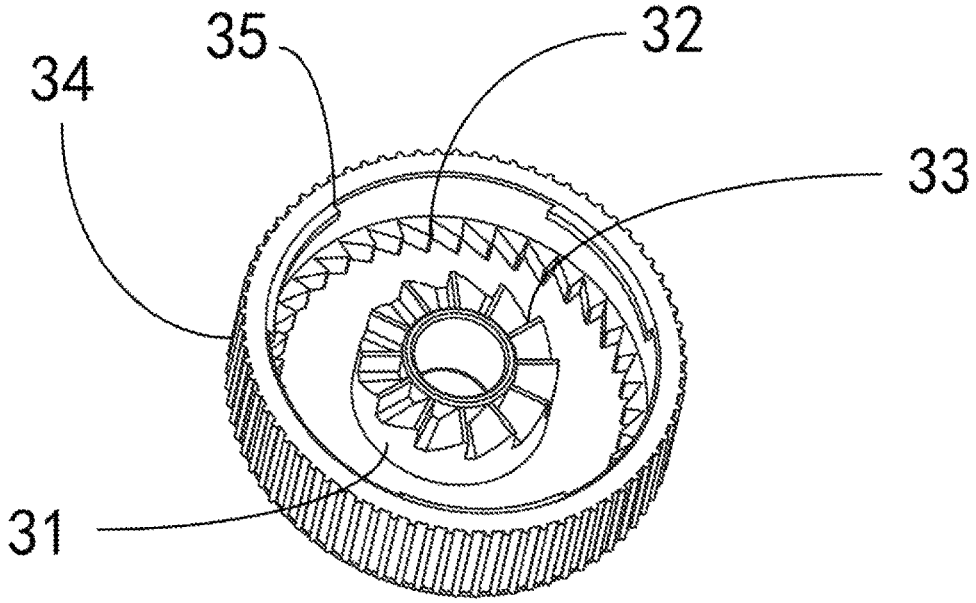
FIG. 4 is a structural schematic diagram of a rotary knob of an embodiment of the present invention.
Figure 5:
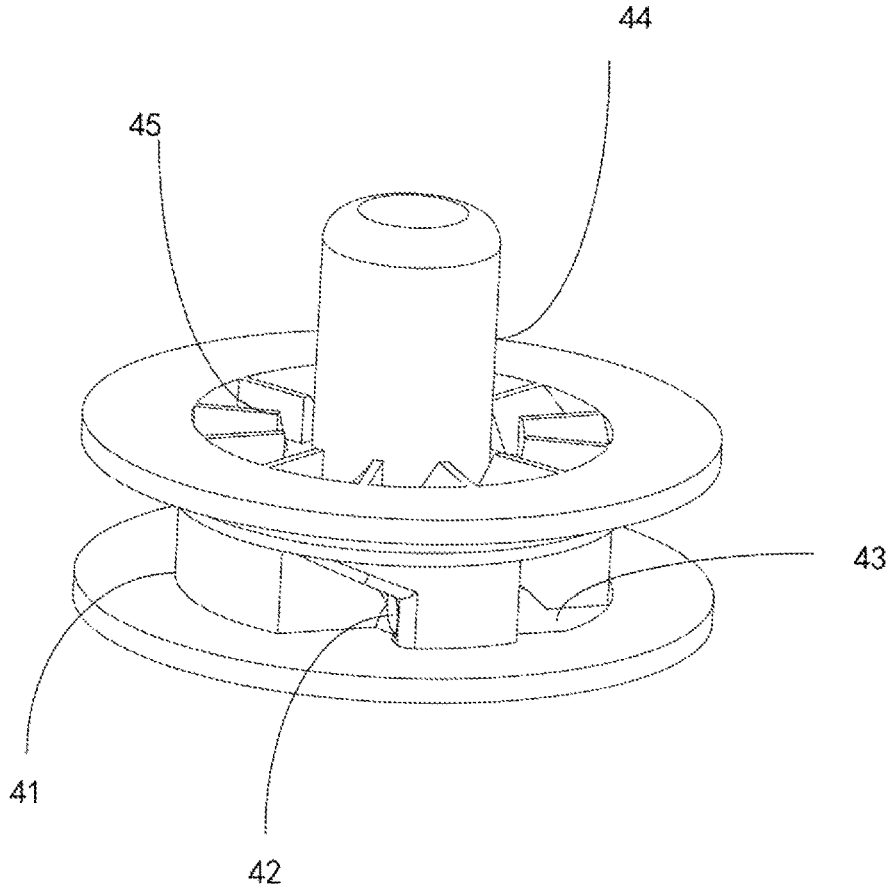
FIG. 5 is a structural schematic diagram of a take-up reel of an embodiment of the present invention.

As shown in FIG. 1 to FIG. 5, the rotary self-lock catch provided by the embodiment, including:

a pedestal 1 fixedly arranged on an article needed to tighten a rope, an upper end being provided with a mounting cavity 11 and a side wall of the mounting cavity 11 being provided with a rope penetrating opening 12, the rope penetrating here;

an arresting disc 2 mounted in the mounting cavity 11 in an aligned manner, limited with the mounting cavity 11 to be prevented from rotating, a periphery of an upper end being provided with at least one elastic buckle, a tail end thereof extending along a same rotating direction, and an outer side of the tail end of the elastic buckle 21 being provided with a first latch 22 inclining equal to the extending direction of the elastic buckle 21;

a rotary knob 3 being buckled to the arresting disc 2 and capable of rotating relative to the arresting disc 2, the rotary knob being provided with a corresponding clamping position 35 to prevent the rotary knob 3 from being separated, a middle portion of an inner cavity being provided with an abutting convex column 31 and a side wall being provided with a second latch 32 matched with the first latch 22, a top end of the abutting convex column 31 being provided with a third latch 33, and after the first latch 22 and the second latch 32 are clamped, the rotary knob 3 being capable of rotating along a direction, the rotating direction being equal to the extending direction of the elastic buckle 21;

a take-up reel 4 placed in the mounting cavity 11, located under the arresting disc 2 and located on a side surface of the take-up reel to form a take-up cavity 41, an inner wall of the take-up cavity 41 being provided with a through hole 42, the other end of the through hole 42 being provided with a hollowed cavity 43, after the tail end of the rope penetrates into the through hole 42, the rope being clamped and fixed to the through hole 42 by way of tying a knot to prevent the rope from being separated from the take-up reel 4, at least one spring 5 being arranged between the bottom of the take-up reel and the mounting cavity 11, the take-up reel having a tendency of bouncing outwards under an action of the spring 5, the upper end of the take-up reel 4 being provided with a pressing convex column 44 and a fourth latch 45 matched with the third latch 33, and under the action of the spring 5, a top end of the pressing convex column 44 being placed outside the rotary knob 3 after penetrating through center axes of the arresting disc 2 and the rotary knob 3 successively.

In specific use, the take-up reel 4 may be driven by the rotary knob 3 under the actions of the third latch 33 and the fourth latch 45 by rotating the rotary knob 3 manually so as to wind the rope in the take-up cavity 41. When the rotary knob stops rotating, under the elastic action of the elastic buckle 21, inclined design of the first latch 22 and the clamping action of the second latch 32, it is prevented from rotating, i.e., the rope is prevented from being drawn from the take-up cavity 41. When necessary to release the rope, only necessary to press the pressing convex column 44 on the take-up reel 4 to compress the spring 5 to separate abutment between the take-up reel 4 and the rotary knob 3, and the take-up reel 4 may rotate. Under the action of tension of the article or an external force, the rope may be released, thereby realizing an effect of loosening the rope.

Further, the arresting disc 2 is not rotatable relative to the pedestal 1, i.e., the arresting disc is limited with the mounting cavity 11. Therefore, in the embodiment, the side surface of the arresting disc 2 is provided with the limiting block 23, the limiting block 23 can be placed in the rope penetrating opening 12 in an aligned manner, the limiting block 23 is provided with a wire channel 24 communicated with the take-up cavity 41, the arresting disc 2 may be limited via the limiting block 23 and the rope penetrating opening 12, and the limiting block 23 is provided with the wire channel 24, so that penetration of the rope is not affected. Therefore, the arresting disc 2 may be limited by means of the rope penetrating opening 12 structurally.

Further, in order to enhance the mounting stability of the spring 5, in the embodiment, a bottom of the mounting cavity 11 and a bottom end of the take-up reel 4 are respectively provided with limiting cavities 13 at the spring 5, and two ends of the spring 5 are respectively placed in the limiting cavities 13 in an aligned manner. The limiting cavities designed in the take-up reel 4 thereof play a primary limiting role to prevent moving of the spring 5 effectively.

Further, as far as mounting stability of the arresting disc 2 is concerned, the embodiment is assembled in a clamping form, i.e., the outer side of the arresting disc 2 in the embodiment is provided with at least one fastener 25, a position of the pedestal 1 located at a bottom or a side wall of the mounting cavity 11 is provided with a clamping opening 14 matched with the fastener 25, and after the arresting disc 2 is placed in the mounting cavity 11, the fastener 25 is directly embedded into the clamping opening 14, thereby realizing a clamping state.

Preferably, an outer side surface of the rotary knob 3 is provided with a skidproof stripe 34 to prevent finger slip during rotation.

The above is merely preferred embodiments of the application and does not hence limit the patent range of the application. Equivalent structure or equivalent flow conversion made by means of the contents of the description and drawings of the application are applied to other related technical fields directly or indirectly, which is, in a similar way, comprised in the protection scope of the patent of the application.

What is claimed is:

1. A rotary self-lock catch, comprising:

a gasket fixedly arranged on an article needed to tighten a cotton rope, an upper end being provided with a mounting cavity and a side wall of the mounting cavity being provided with a rope penetrating opening;

an arresting disc mounted in the mounting cavity in an aligned manner, limited with the mounting cavity to be prevented from rotating, a periphery of an upper end being provided with at least one elastic buckle, a tail end thereof extending along a same rotating direction, and an outer side of the tail end of the elastic buckle being provided with a first latch inclining equal to the extending direction of the elastic buckle;

a screw cap being buckled to the arresting disc and capable of rotating relative to the arresting disc, a middle portion of an inner cavity being provided with an abutting convex column and a side wall being provided with a second latch matched with the first latch, and a top end of the abutting convex column being provided with a third latch; and a take-up reel placed in the mounting cavity, located under the arresting disc and located on a side surface of the take-up reel to form a take-up cavity, an inner wall of the take-up cavity being provided with a through hole, the other end of the through hole being provided with a hollowed cavity, at least one spring being arranged between the bottom of the take-up reel and the mounting cavity, the take-up reel having a tendency of bouncing outwards under an action of the spring, the upper end of the take-up disc being provided with a pressing convex column and a fourth latch matched with the third latch, and under the action of the spring, a top end of the pressing convex column being placed outside the screw cap after penetrating through center axes of the arresting disc and the screw cap successively.

2. The rotary self-lock catch as claimed in claim 1, a side surface of the arresting disc is provided with a limiting block, the limiting bloc is placed in the rope penetrating opening in an aligned manner, and the limiting block is provided with a wire channel communicated with the take-up cavity.

3. The rotary self-lock catch as claimed in claim 1, a bottom of the mounting cavity and a bottom end of the take-up reel are respectively provided with limiting cavities at the spring, and two ends of the spring are respectively placed in the limiting cavities in an aligned manner.

4. The rotary self-lock catch as claimed in claim 1, an outer side of the arresting disc is provided with at least one fastener, and a position of the gasket located at a bottom or a side wall of the mounting cavity is provided with a clamping opening matched with the fastener.

5. The rotary self-lock catch as claimed in claim 1, an outer side surface of the screw cap is provided with a skidproof stripe.

* * * * *